United States Patent [19]

Brodmann

[11] Patent Number: 4,812,142

[45] Date of Patent: Mar. 14, 1989

[54] COLORED POLYCARBONATE ARTICLES WITH HIGH IMPACT RESISTANCE

[75] Inventor: George L. Brodmann, Greensboro, N.C.

[73] Assignee: Burlington Industries, Inc., Greensboro, N.C.

[21] Appl. No.: 127,086

[22] Filed: Dec. 1, 1987

[51] Int. Cl.[4] ..... D06P 3/52

[52] U.S. Cl. ..... 8/512; 8/506; 8/507

[58] Field of Search ..... 8/512, 507, 506

[56] References Cited

U.S. PATENT DOCUMENTS 4,076,496 2/1978 Hamand ..... 8/512

FOREIGN PATENT DOCUMENTS 0017156 5/1980 Japan ..... 8/512

*Primary Examiner*—Prince E. Willis
*Assistant Examiner*—John F. McNally
*Attorney, Agent, or Firm*—Nixon & Vanderhye

[57] ABSTRACT

Polycarbonate articles, especially eyeglass and optical lenses, are dyed in a dye solvent having a boiling point of at least 350° F. in which a dye is dissolved. The article to be dyed is retained in the solution maintained at 200° F. or more until sufficient dye has penetrated the polycarbonate, then removed, rinsed and dried. The dyeing operation does not unduly detract from impact resistance and the dyed product exhibits excellent ultraviolet light stability.

11 Claims, No Drawings

COLORED POLYCARBONATE ARTICLES WITH HIGH IMPACT RESISTANCE

BACKGROUND OF THE INVENTION

Polycarbonate lenses of the type used in eyeglasses, camera lenses, optical instruments, eyeglass shields, goggles and other protective gear, cannot be dyed at temperatures of 212° F. or less, because of the high second order transition temperature ($T_g$) (250°-260° F.) of the polycarbonate. Aqueous dyeing under pressure at 265°-270° F. for 60-90 minutes is needed to obtain good coloration. However, this long heat treatment is costly and slow, and drastically reduces the impact resistance of the polycarbonate article. During the long heat treatment, the molding-related physical arrangements undergo changes which cause the loss of impact resistance. High impact resistance is a necessary requirement for all plastic lenses, and it is a special requirement for the military.

Thus, an object of this invention is to develop a rapid solvent dyeing process with uniform dye uptake without reducing the high impact resistance or changing the haze factor of dyed polycarbonate lenses.

Polycarbonate lenses are produced by placing liquid polycarbonate monomer (undyed) and an initiator, usually an organic peroxide, e.g., isopropyl peroxide, in a mold. After polymerization is completed, the lenses are polished and cleaned. Normally, lenses are dyed by adding organic dye to the monomer and initiator blend. These dyes must be compatible with both the monomer and initiator. This process requires a significant investment for dyes and an inventory of colored lenses to provide a full range of products.

Polycarbonate articles including lenses which contain tint or dye are required for optical and nonoptical uses, such as safety glasses and sunglasses, and for industrial and military applications such as helmets with protective face shields.

DESCRIPTION OF THE INVENTION

The present invention provides a dyeing process effective for dyeing polycarbonate lenses to obtain high retention of impact resistance, uniform dyeing, high UV stability (clarity) of the thus-colored lenses, no change in haze of the lens, and high productivity.

The effects of time and temperature of treatment on polycarbonate lens dyeing are shown below in Table III. Based on those tests, a dyeing process was developed to provide the advantages mentioned above. An outline of this process is as follows:

Polycarbonate lenses are dyed in a solution consisting of 0.1 to 1% of selected organic dye (see below) in white mineral oil. The oil is a naphthenic hydrocarbon, NF/USP pharmaceutical grade, and is referred to herein as "white mineral oil". Dyeing is preferably conducted for 3 to 4 minutes at 268°-270° F.

Annealing is performed at about 80°-85° F. for 3-4 minutes. Excess solvent and dye are then scoured off as described below, and the lenses are then dried at room to warm air temperature. A hard siloxane can then be applied as a coating to improve the lenses' scratch resistance. To avoid dye oxidation, oxygen-free gas, e.g., nitrogen, should be used above the dye and scouring baths; this is required if the dye solution is to be re-used.

The following nonionic, organic dyes have been found suitable for the process:

Crude Nonionic Dyes

Disperse Yellow 3
Disperse Orange 30
Disperse Red 55:1
Disperse Blue 56

Solvent Nonionic Dyes

Solvent Yellow 93
Solvent Orange 60
Solvent Red 52
Solvent Blue 59

Solvent 1:2 Premetalized Dyes

Solvent Yellow 83:1
Solvent Orange 54
Solvent Red 22

The process of this invention can be carried out at temperatures and times between 250° F. for 4 minutes and 380° F. for 30 seconds depending upon the dyeing media employed. Preferably, however, the process is carried out between 270° F. for 3 minutes and 290° F. for 2 minutes. The annealing time can vary between 2 and 4 minutes.

The process of the invention is conducted in the following manner: molded but otherwise untinted lenses are tinted or dyed by immersing the lens in a high-boiling solvent (specified in detail below) containing a tinctorial amount of at least one dye. The dyeing medium is maintained in a sealed container under an inert gas, nitrogen being convenient, to prevent dye oxidization. Dyeing is carried out at temperatures in the range of 250° F. to 380° F., preferably about 270° F. to 290° F. for 5 seconds up to 5 minutes depending on the depth of shade required. Temperature and time are inversely related, i.e., lower temperatures require longer exposure to the dyeing medium.

Next, the lens is given an after dyeing heat treatment or annealing, again in a nitrogen environment, to prevent dye oxidation. After annealing, any non-diffused dye and/or high boiling solvent remaining on the lens are removed in a solvent rinse or scour, for instance, in a fluorinated hydrocarbon scouring medium (e.g. Freon 113) optionally containing a small quantity of a solvent-soluble detergent. Three separate scourings of 15 to 30 seconds each with the fluorinated hydrocarbon scouring medium at slightly above room temperature (80° F. to 85° F.) are preferred. The dyed lens is then dried in warm air. Protective coatings or other finishes may be applied as required.

The process of this invention is described with emphasis on a lens, shield or other optically-related configuration; however, it will be understood that other forms of three-dimensional shaped articles made of polycarbonate may be similarly treated.

The total light transmittance of the dyed lenses varies with the depth of dyeing which, in turn, is a function of the materials and conditions employed. Approximately 20% to 25% light transmittance of the dyed lenses is preferable, e.g., for sunglasses. The process yields uniformly dyed lenses or articles with no visible change in haze (clarity) as compared with untreated lenses.

Suitable high-boiling organic media for the process of this invention are selected from those organic liquids having a boiling point above the operational temperature of the dyeing medium, compatible with the polycarbonate article to be dyed and in which the dye is soluble. Several types of solvents for dyeing and scouring media were screened to obtain optimum materials for processing as shown in Tables I and II, below.

TABLE 1

Properties of Candidate Media for Dyeing Polycarbonate Lenses

| Solvent | Boiling Point °F. | Viscosity at 75° F. cps | Viscosity at 270° F. cps | Cost $/lb | UV stability[d] | Depth of Dyeing at[e] 270° F. | 300° F. | 350° F. |
|---|---|---|---|---|---|---|---|---|
| Diethylene glycol | 470 | 80 | 15 | 0.40 | 3–4 | Low | Med. | High |
| Dow Corning | | | | | | | | |
| 200 Fluid[a] | 380 | 500 | 180 | 2.80 | 3–4 | Low | Med. | High |
| 510 Fluid | 410 | 400 | 160 | 4.50 | 3–4 | Low | Med. | High |
| 210H Fluid | 800 | 180 | 45 | 9.50 | 5 | Low | High | — |
| 710 Fluid | 650 | 250 | 80 | 18.50 | 3–4 | Low | High | — |
| 550 Fluid | 480 | 500 | 180 | 8.90 | 5 | Low | Med. | High |
| Polysulfolane | 520 | solid | 30–50 | 1.70 | 2–3 | Low | Med. | High |
| TEHM[b] | 650 | 400 | 15–30 | 2.80 | 3–4 | Low | High | — |
| White Mineral Oil[c] | 600 | 20–30 | 1–2 | 0.68 | 5 | High | — | — |

[a]Silicone fluid.
[b]Tris(2-ethylhexyltrimellitate).
[c]Naphthenic hydrocarbon NF/USP pharmaceutical white mineral oil.
[d]UV stability in AATCC Test 16E, using 60 hours of continuous xenon arc exposure. A rating of 5 is best, and indicates absence of a color break.
[e]The test for depth of dyeing was conducted in a 0.5% solution of Solvent Blue 59 for 2 minutes at the specified temperatures.

TABLE II

Properties of Candidate Media for Scouring Dyed Polycarbonate Lenses

| | Solubility of White Mineral Oil | Solubility of Organic Dyes | Effect on Polycarbonate Lens Surface |
|---|---|---|---|
| Dimethyl sulfoxylate | Medium | High | Severe |
| Dimethylformamide | Medium | High | Severe |
| Methylethyl ketone | Medium | Medium | Severe |
| Methylethyl acetate | Medium | Medium | Severe |
| Perchloroethylene | High | Medium | Severe |
| Trichloroethylene | High | Medium | Severe |
| 1,1,1-Trichloroethane | High | Medium | Slight |
| Methylene chloride | Medium | Medium | Severe |
| Fluorinated hydrocarbon (Freon 113) | High | Low/Medium* | None |

*Solubility of dyes can be increased by addition of cationic detergent soluble in fluorinated hydrocarbon.

As shown by Table I, the dyeing media tested (with the exception of white mineral oil) provided a low depth of dyeing at 270° F., but demonstrated improved dyeing depths at higher temperatures. Impact resistance was least affected at lower treatment temperatures as shown by Table II. Thus, the preferred dyeing medium is white mineral oil, not only for the favorable depth of dyeing at lower temperatures, but also for the ultraviolet stability of the resulting product. An acceptable scouring medium will solubilize and remove the high boiling medium and solubilize the organic dye (at least to a reasonable extent while not extracting a significant portion of the dye diffused into the lens) while the polycarbonate lens surface should not be adversely affected. Fluorinated hydrocarbons are the preferred scouring agents for use in association with white mineral oil as the dyeing medium, as shown in Table II.

The invention will now be explained with reference to the following example in which all parts and percents are by weight unless otherwise indicated.

EXAMPLE

A series of 14 separate dye uptake studies were made in a 0.5% solution of Solvent Blue 59 in white mineral oil for two minutes under the times and temperatures specified, as shown in Table III.

Table III

Effect of Treating Conditions on Polycarbonate Lens Dyeing
Test for Dye Uptake: Conducted in a 0.5% solution of Solvent Blue 59 in White Mineral Oil for 2 minutes at the specified temperatures.

| Dyeing Experiment No. | Conditions Temp. °F. | Conditions Time Min. | Annealing Time at 80° F. Min. | Dye Uptake | UV* Stability | Impact** Resistance |
|---|---|---|---|---|---|---|
| 1 | 260 | 1 | 2 | None | — | High |
| 2 | 260 | 2 | 2 | Low | 1 | High |
| 3 | 260 | 4 | 2 | Low | 2 | High |
| 4 | 270 | 1 | 2 | Medium | 2–3 | Med./High |
| 5 | 270 | 2 | 2 | Med./High | 4–5 | Med./High |
| 6 | 270 | 3 | 2 | High | 5 | Med./High |
| 7 | 270 | 4 | 2 | High | 5 | Med./High |
| 8 | 270 | 3 | 2 | High | 5 | Med./High |
| 9 | 270 | 3 | 3 | High | 5 | High |
| 10 | 270 | 3 | 4 | High | 5 | High |
| 11 | 280 | 2 | 4 | High | 5 | Low |
| 12 | 300 | 2 | 4 | High | 5 | Low |
| 13 | 325 | 2 | 4 | High | 5 | Low |
| 14 | 350 | 2 | 4 | High | 5 | Low |

*UV stability in AATCC TEST 16E, using 60 hours of continuous Xenon arc exposure. A rating of 5 is best, and indicates absence of a color break.
**Qualitative judgment of cracking after dropping a 10 lb. weight from a height of one foot on lens specimens.

What is claimed is:

1. A process of dyeing a shaped polycarbonate article comprising the steps of:

(1) immersing a polycarbonate article in a dyeing medium composed of a organic solvent having a boiling point of at least 350° F. containing a tinctorial amount of at least one dye dissolved therein selected from the group consisting of crude nonionic dyes, solvent nonionic dyes and premetalized dyes and maintaining the solution at a temperature of at least 200° F. while retaining the article in the solution for a period of time sufficient to allow a predetermined level of the dye to penetrate into and dye the polycarbonate article without substantially reducing the impact strength of the article;

(2) removing the article from the solution and rinsing the article with a solvent for the dyeing medium to remove any unfixed dye from the article; and (3) drying the thus-dyed article to produce a uniformly dyed polycarbonate article.

2. The process of claim 1 in which, prior to rinsing, the dyed article is annealed for up to 5 minutes at elevated temperature.

3. The process of claim 1 in which the dyeing is conducted in an oxygen-free atmosphere.

4. The process of claim 2 in which the annealing is conducted in an oxygen-free atmosphere.

5. The process of claim 1 in which the article is scoured in a fluorinated hydrocarbon.

6. The process of claim 1 in which the solvent is selected from the group consisting of diethylene glycol, a fluid silicone, tris(2-ethylhexyltrimellitate) and white mineral oil.

7. A process of dyeing a shaped polycarbonate article comprising the successive steps of:

(1) immersing the polycarbonate article to be dyed in a dyeing medium containing a tinctorial amount of at least one dye dissolved in white mineral oil and retaining the article in the dyeing medium at about 250° F. to about 400° F. for a period of from 30 seconds to about 4 minutes until the article has been dyed to a predetermined depth while the dyeing medium is maintained under oxygen-free conditions;

(2) annealing the polycarbonate article at a temperature from about 65° F. to about 100° F. in an oxygen-free atmosphere for up to 5 minutes;

(3) rinsing the dyed and annealed article in a fluorinated hydrocarbon to remove any unattached dye or any dyeing medium remaining on the article; and (4) drying the article to produce a dyed polycarbonate article having an impact resistance of at least 80% of the impact resistance of the same article prior to dyeing.

8. The process of claim 7 in which the dyed article has an ultraviolet stability of at least 4 according to AATCC Test 16E.

9. The process of claim 7 in which dyeing step (1) is conducted at about 270° F. to about 290° F. for about 1 to about 4 minutes.

10. The process of claim 7 in which the article is annealed at about 80° to about 90° F. for 1 to 4 minutes.

11. The process of claim 7 including the additional step of:

(5) applying a scratch-resistant coating to the dyed polycarbonate article.

* * * * *